US006748190B2

(12) United States Patent
Yanagisawa et al.

(10) Patent No.: US 6,748,190 B2
(45) Date of Patent: Jun. 8, 2004

(54) APPARATUS AND METHOD FOR REPLENISHING A DEVELOPING DEVICE WITH TONER WHILE SUPPRESSING TONER REMAINING

(75) Inventors: Takaaki Yanagisawa, Tokyo (JP); Masumi Sato, Tokyo (JP); Kazuhiko Yuuki, Tokyo (JP); Akio Kosuge, Tokyo (JP); Yoshinori Ozawa, Tokyo (JP); Yoshi Hattori, Tokyo (JP); Tomotoshi Nakahara, Tokyo (JP); Kouta Fujimori, Tokyo (JP); Satoshi Muramatsu, Tokyo (JP); Junichi Matsumoto, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/434,174

(22) Filed: May 9, 2003

(65) Prior Publication Data

US 2003/0198487 A1 Oct. 23, 2003

Related U.S. Application Data

(62) Division of application No. 09/785,234, filed on Feb. 20, 2001, now Pat. No. 6,567,637.

(30) Foreign Application Priority Data

Feb. 17, 2000 (JP) ..... 2000-039843

(51) Int. Cl.[7] ..... G03G 15/08

(52) U.S. Cl. ..... 399/258; 222/DIG. 1; 399/260; 399/262; 399/120

(58) Field of Search ..... 222/DIG. 1, 167; 399/92, 93, 120, 123, 254, 256, 258, 260, 262, 265, 358, 359

(56) References Cited

U.S. PATENT DOCUMENTS

| | | | |
|---|---|---|---|
| 4,377,334 | A | 3/1983 | Nishikawa |
| 4,499,849 | A | 2/1985 | Tomita et al. |
| 4,547,059 | A | 10/1985 | Nagayama et al. |
| 4,571,070 | A | 2/1986 | Tomita |
| 5,074,342 | A | 12/1991 | Kraehn |
| 5,105,222 | A | 4/1992 | Ohta et al. |
| 5,386,274 | A | 1/1995 | Sanpe et al. |

(List continued on next page.)

FOREIGN PATENT DOCUMENTS

| | | |
|---|---|---|
| EP | 1 154-333 | 11/2001 |
| JP | 59-027558 | 2/1984 |
| JP | 61-156176 | 7/1986 |
| JP | 4-009082 | 1/1992 |
| JP | 07-020702 | 1/1995 |
| JP | 08-127229 | 5/1996 |
| JP | 09-197818 | 7/1997 |
| JP | 09-006108 A | 10/1997 |
| JP | 10-123814 | 5/1998 |
| JP | 11-237823 | 8/1999 |
| JP | 11-282236 | 10/1999 |
| JP | 2000-227706 | 8/2000 |
| JP | 2000-267415 | 9/2000 |

*Primary Examiner*—Hoang Ngo
(74) *Attorney, Agent, or Firm*—Oblon, Spivak, McClelland, Maier & Neustadt, P.C.

(57) ABSTRACT

A toner replenishing device includes a toner conveyance path for connecting a toner storing device with a developing device, a toner conveying device for conveying the toner from the toner storing device to the developing device along the toner conveyance path, and an air supplying device connected to the toner conveyance path vie an air supply path for supplying the toner storing device with air from a bottom of the toner storing device so as to agitate the toner pooling in the toner storing device.

28 Claims, 12 Drawing Sheets

U.S. PATENT DOCUMENTS 5,576,816 A 11/1996 Staudt et al.
5,592,267 A 1/1997 Misago et al.
5,595,223 A 1/1997 Hayao
5,638,159 A 6/1997 Kai et al.
5,655,180 A 8/1997 Yasuda et al.
5,662,944 A 9/1997 Petrucco
5,663,788 A 9/1997 Sanpe
5,734,957 A 3/1998 Ogawa et al.
5,797,074 A 8/1998 Kasahara et al.
5,815,784 A 9/1998 Kasahara et al.
5,875,380 A 2/1999 Iwata et al.
5,878,317 A 3/1999 Masuda et al.
5,950,055 A 9/1999 Yahata et al.
5,953,567 A 9/1999 Muramatsu et al.
5,960,238 A 9/1999 Ohgami
5,960,246 A 9/1999 Kasahara et al.
5,962,783 A 10/1999 Iwata et al.
5,987,298 A 11/1999 Muramatsu et al.
6,032,010 A 2/2000 Kim et al.
6,112,046 A 8/2000 Suzuki et al.
6,122,468 A 9/2000 Sakamoto et al.
6,128,459 A 10/2000 Iwata et al.
6,142,690 A 11/2000 Yoshimura et al.
6,163,669 A 12/2000 Aoki et al.
6,193,113 B1 2/2001 Hidding
6,198,895 B1 3/2001 Tsuda et al.
6,201,941 B1 3/2001 Kasahara et al.
6,249,304 B1 6/2001 Sawayama et al.
6,249,305 B1 6/2001 Miyamoto et al.
6,282,396 B1 8/2001 Iwata et al.
6,295,437 B1 9/2001 Hodoshima et al.
6,304,739 B1 10/2001 Katsuyama et al.
6,337,957 B1 1/2002 Tamaki et al.
6,363,232 B1 3/2002 Flaherty
6,381,435 B2 4/2002 Shinohara et al.
6,386,392 B1 5/2002 Argentieri et al.
6,393,241 B1 5/2002 Matsumoto et al.
6,465,144 B1 10/2002 Hashimoto et al.
6,501,913 B2 12/2002 Hattori et al.
6,505,014 B2 1/2003 Aoki et al.
6,505,022 B2 1/2003 Kosuge et al.
6,507,720 B2 1/2003 Kabumoto et al.
6,522,855 B1 2/2003 Katoh et al.
6,526,246 B2 2/2003 Iwata et al.

APPARATUS AND METHOD FOR REPLENISHING A DEVELOPING DEVICE WITH TONER WHILE SUPPRESSING TONER REMAINING

CROSS REFERENCE TO RELATED APPLICATION

This application claims priority under 35 U.S.C. §119 to Japanese Patent Application No. 2000-039843 filed on Jan. 17, 2000, and its internal priority claiming application number of which is not yet known, the entire contents of which are herein incorporated by reference. This application is also a divisional application of allowed U.S. parent application Ser. No. 09/785,234, filed on Feb. 20, 2001, now U.S. Pat. No. 6,567,637.

BACKGROUND OF THE INVENTION

1. Field of the Invention

The present invention generally relates to an image forming apparatus, such as a printer, a copier, a facsimile, etc., and in particular relates to a toner replenishing device capable of replenishing a developing device with toner stored in a toner storage container.

2. Discussion of the Background

In known image forming apparatuses, such as printers, copiers, facsimiles, etc., a toner storage container such as a toner bottle or a toner cartridge is disposed within or in the vicinity of a unit which mounts a developing device. The developing device generally is replenished directly or via a toner hopper with toner conveyed from the toner storage container. In such a construction, conveyance of the toner from the toner storage container to the developing device generally is performed by a mechanical auger such as a screw, a paddle, etc.

However, when the mechanical auger conveys the toner, since the screw, for example, can only be arranged substantially straight, the toner storage container and the toner replenishing device are necessarily integrated with, or in the vicinity of, the developing device. Thus, the construction of the toner replenishing device is complex, costly and has low productivity and a low machine maintenance performance. In addition, protection and maintenance of toner quality characteristics are burdensome. In addition, it is generally difficult for a user to exchange a toner storage container.

Japanese Patent Application Laid Open No. 04-9082A has proposed a toner replenishing device capable of suppressing such problems. Specifically, the toner replenishing device conveys toner using suction generated by a suction device, and has an advantages that toner can be replenished, whatever positional relationship exists between a toner storage container and a developing device or the like.

However, toner utilized in an image forming apparatus which employs an electrophotographic system generally has greatly poor fluidity, and it is typically noted that conveyance of such toner is difficult. Accordingly, there are problems in the above noted toner replenishing device that toner clogging easily arises at a leading end or a middle portion of a suction pipe, and as a result, toner is not smoothly replenished.

SUMMARY OF THE INVENTION

Accordingly, it is an object of the present invention to address the above and other problems and provide a new image processing apparatus. The above and other objects are achieved according to the present invention by providing a novel toner replenishing device including a toner conveyance path extending from a toner storing device to a developing device, a toner conveying device for conveying toner from the toner storing device to the developing device along the toner conveyance path, and an air supplying device connected to the toner conveyance path via an air supply path for supplying the toner storing device with air from a bottom of the toner storing device so as to agitate the toner pooling in the toner storing device.

In yet another embodiment, the toner storing device includes an evacuation section at a top thereof so as to evacuate and receive air.

In yet another embodiment, the evacuation section is made of a breathable filter so as to efficiently evacuate the air.

In yet another embodiment, a multicolor image forming apparatus includes an air supply control device for controlling supplying of air to a plurality of toner storing devices and a fewer number of air generation sources than the plurality of toner storing devices so as to efficiently supply the air to the plurality of toner storing devices.

In yet another embodiment, the air supply control device controls both the driving of the air generation source and the opening and closing of a plurality of openable valves provided in a plurality of toner conveyance paths in such a manner that the plurality of toner storing devices is supplied with air one after another when the air generation sources are driven, so that an amount of air supplied to each of the toner storing devices can independently be supervised.

In yet another embodiment, the toner conveyance path is configured to receive at its middle portion user toner collected by a cleaning device so as to recycle the toner and protect the used toner from needless stress.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
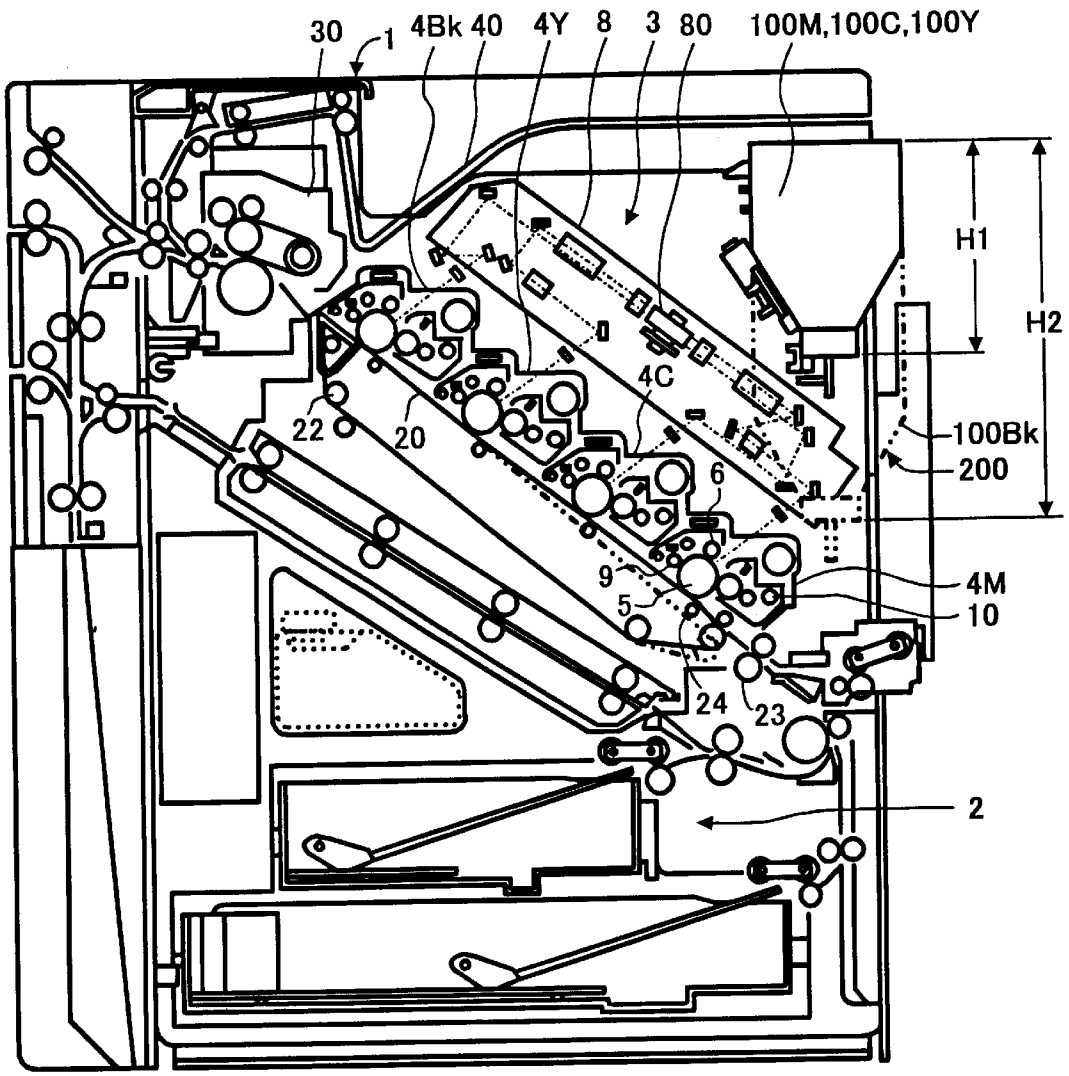
FIG. 1 is a schematic diagram illustrating a color laser printer as one example of an image forming apparatus which is equipped with a toner replenishing device according to the present invention.

Referring now to the drawings, wherein like reference numerals designate identical or corresponding parts throughout several views. FIG. 1 is a schematic diagram illustrating a color laser printer as one example of an image forming apparatus which is equipped with a toner replenishing device according to the present invention. The color laser printer may be configured to include a sheet feeding section 2 arranged at a bottom of its apparatus body, and an image forming section 3 arranged above the sheet feeding section 2. A transfer belt unit may be provided in the image forming section 3, inclined such that a sheet feeding section side is below an ejection side. The transfer belt unit may include an endless transfer belt 20 wound around a plurality of (e.g. four) belt pulleys 22. Four image forming units 4M, 4C, 4Y, and 4Bk, for magenta, cyan, yellow and black images, respectively, may be disposed on an upper running side 21 of the transfer belt 20, and may be arranged in parallel in this order, starting from the lowermost end.

As noted from FIG. 1, each of the image forming units 4M, 4C, 4Y, and 4Bk may include a photoconductive drum (PC drum) 5 as an image carrier. The PC drum 5 may be rotated clockwise by a driving device (not shown). Around the PC drum 5 there may be provided a charge roll 6 as a charging device, an optical write section including an optical write device 8 for writing with a laser beam, a developing device 10, and a cleaning device 9. The developing device 10 may be a two component type wherein toner and carrier are employed. The developing device 10 may be replenished with toner by a later described replenishing device corresponding to a toner consumption amount.

A sheet designated as a transfer member may be fed from the sheet feeding section 2, and may strike against, and temporarily stop at, a register roller 23 provided upstream of the transfer belt 20. The sheet may then fed onto the transfer belt 20 in synchronism with the visualized image, and may arrive at a transfer position opposing the PC drum 5 as transferred by the transfer belt 20. The image having the magenta toner may be transferred onto the sheet at the transfer position by operation of the transfer roller 24 engaged with the backside of the transfer belt 20.

Other mono color toners may also visualize a plurality of remaining mono color images, respectively, on the surface of respective ones of the PC drums 5 of the respective image formation units 4C, 4Y, and 4Bk. Each of these visualized images may be transferred and superimposed every time the sheet arrives at each of the transfer positions. Thus, the color laser printer can quickly transfer and superimpose a full color image as a monochrome image. The sheet may then be separated from the transfer belt 20 and fixed by the fixing device 30. The sheet may be ejected outside the color laser printer after completing the fixing. Otherwise, the sheet may be inverted and ejected onto an ejection tray 40 which is constituted by an upper surface of the apparatus body 1 with its backside facing upward. Such backside ejection may be an essential condition for a printer when arranging the sheets in order of pages.

Figure 2:
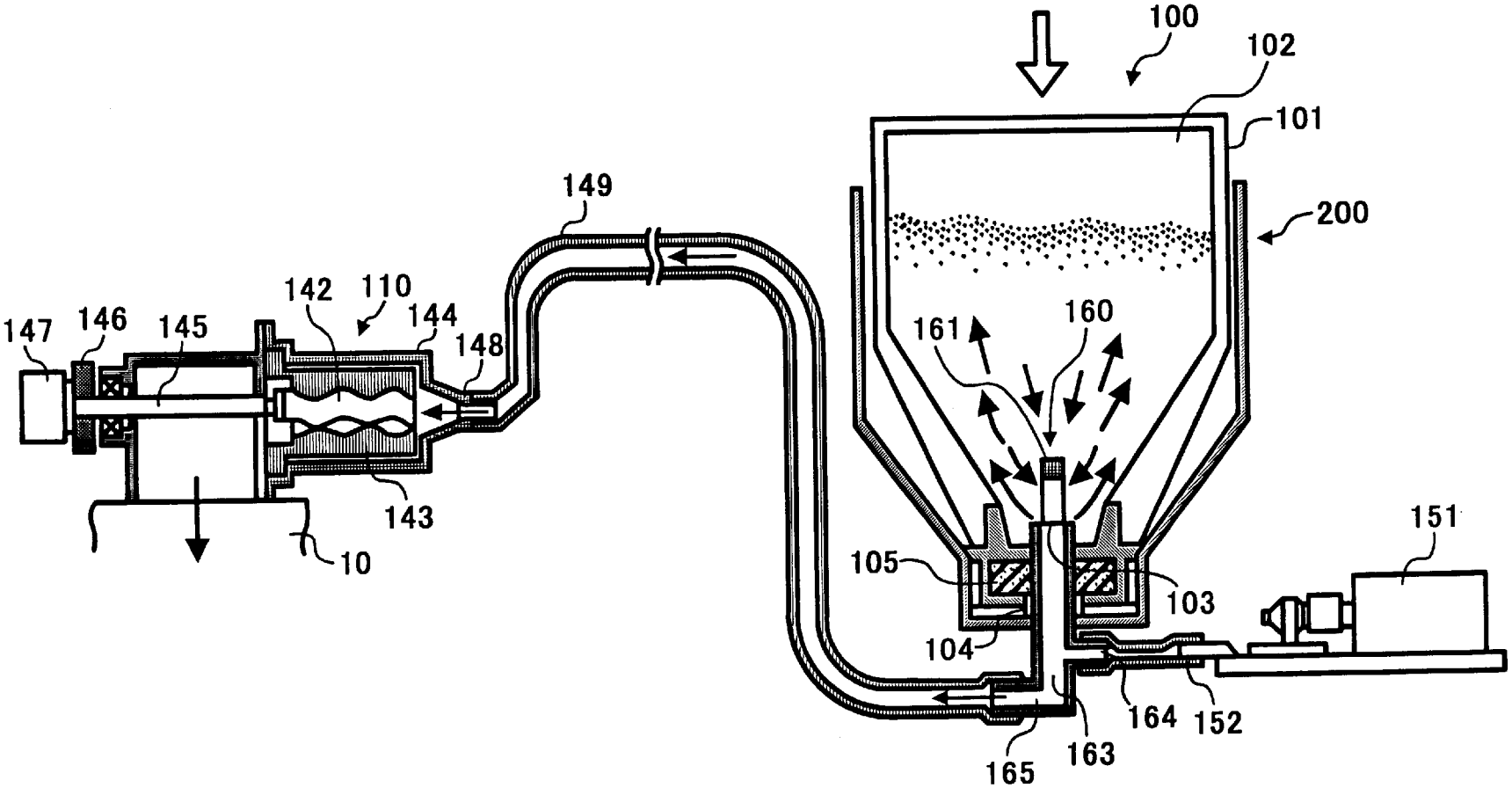
FIG. 2 is a diagram illustrating a toner replenishing device according to the present invention.

A toner replenishing device for replenishing each of image formation units 4M, 4C, 4Y, and 4Bk with applicable toner contained in each of toner storage containers 100M, 100C, 100Y, and 100Bk is now described with reference to FIG. 2. A construction of each toner replenishing device may substantially be the same.

A uniaxial eccentric screw pump as a powder pump 110 of a suction type may be provided in a body or in the vicinity of the developing device 10. The powder pump 110 may be constructed with a rotor 142 which is made of rigid material such as metal and is formed in an eccentric screw shape, a stator 143 which is made of elastic material such as rubber and is formed in a two rowed screw shape, and a holder 144 which is made of plastic and encloses these devices, thereby forming a conveyance path for powder. The rotor 142 may be driven via a gear 146 connected in a body to a driving shaft 145 via a pin joint. An electromagnet clutch 147 controls an operation of the powder pump 110.

At the leading end of the holder 144 (i.e., at a right end in FIG. 2), there may be provided a toner suction section 148. The toner suction section 148 may be connected to a toner use connection opening 165 disposed at one end of a nozzle 160 (described later in detail) via a toner conveyance tube 149. The toner conveyance tube 149 may be flexible and have a diameter of from 4 to 10 mm, and may be made of rubber such as polyurethane, nitrile, EPDM, silicon, etc., having superior resistance to degradation by toner, so that the tube can be easily arranged in an optional direction such as upward, downward, rightward, leftward, etc. It is noted that the powder pump 110 can continuously convey a prescribed amount of toner at a high substance/air ratio, and the toner conveyance amount accordingly can be precisely in proportion to the number of rotations of the rotor 142. To this end, when a toner replenishment instruction is generated after image density detection or the like, the powder pump 110 may operate so as to replenish the developing device 10 with a requested mount of toner.

A set portion 200 (see FIG. 2) may be provided in the image forming apparatus body 100 as to accept the toner storage container 100. The set portion 200 may separately be constructed from the developing device 10. A stationary nozzle 160 maybe installed in the set portion 200 in a standing condition to be inserted into a toner bag 102 and have a circular cross section. The toner storage container 100 may be set onto the set portion 200 from above. The nozzle 160 may have a single tube construction and include, at its upper section, a tapered member 161 which has a cone shape section and is integrally molded or fixed thereto. Downwardly extending from the tapered member 161, there may be provided a passage 163 which serves both as air supply and toner replenishment routes. The nozzle 160 may have, at its interior, a single tube construction. The passage 163 may be bent leftward, when viewing the drawing, at the lowermost end of the nozzle 160. At a leftmost leading end of the passage 163, there may be provided a toner use connection opening 165 which is inserted into the toner conveyance tube 149. The passage 163 may also be bent rightward when viewing the drawing at a position above the toner use connection opening 165 and provided with an air connection opening 164.

The air connection opening 164 may be connected to an air pump 151 as an air supply source via an air transfer pipe 152. When the air pump 151 operates, some air may gush out into the toner storage container 100 from the lower side thereof via the air transfer pipe 152 and the air supply route. This air may then agitate and thereby fluidize the toner while passing through a toner pool.

The toner storage container 100 may be a bag in a box type and is constructed by an external box 101 as a protection case, and a toner bag 102 of a bag shape, which is detachably installed and has flexibility so as to be deformed. The external box 101 may be made of rigid material such as paper, corrugated paper, plastic, etc., and has a prescribed internal dimension that is capable of accepting the toner bag 102 substantially without creating a gap therebetween. Thus, the toner storage container 100 may have advantages of easy handling and sorting during storage, in addition to protection of the flexible toner bag 102.

Further, a bag portion of the toner bag 102 may be constructed by a single layer or a plurality of layers of a flexible sheet like material having thickness of from 80 to 125 mm. The flexible material may be made of polyester, polyethylene, etc. A mouthpiece member 103 made of plastic such as polyethylene, nylon, etc., may be secured to the toner bag 102 and includes, at substantially the center of the bottom section, a toner ejection hole 104. In the mouthpiece member 103, there may be provided a seal member 105 which is constituted by a single or a plurality of layers and made of stiff elastic material such as expanded sponge, etc. The seal member 105 may function as a shut-in valve. The toner bag 102 may have a tapered shape narrowing to the toner ejection hole 104 so that toner hardly remains therein. Accordingly, a nozzle 160 may be inserted into the toner storage container 100 in the vertical direction from the lower side thereof (i.e., right down side) when the toner storage container 100 is set onto the set portion 200.

With the above described image forming apparatus, when toner is suctioned by the powder pump 110 and if an angle of a slope of the toner bag towards its bottom is small, since the toner hardly drops in the vicinity of the nozzle 160 by gravity, the toner remains in the bag. Since the remaining toner may become readily suctioned if sufficiently agitated and fluidized while the toner storage container 100 is supplied with extensive air, an amount of the remaining toner can be greatly minimized (in such situation). However, since an amount of air supplied to the toner storage container 100 is limited to a capacity of the toner storage container 100, the toner may probably be insufficiently agitated, due to insufficient supply of air.

Figure 3B:
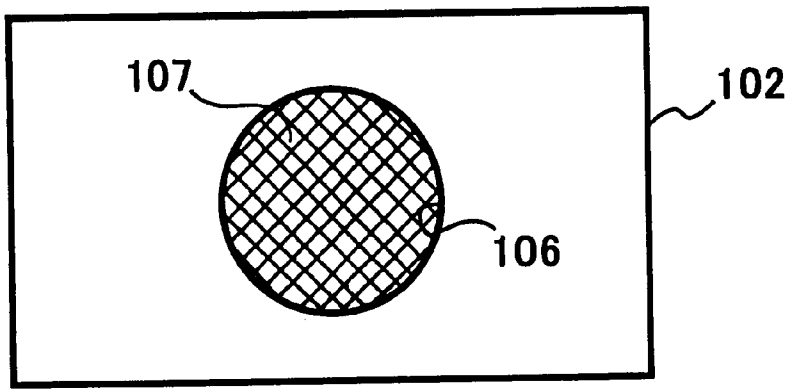
FIGS. 3A and 3B are front and plan views illustrating the toner replenishing device illustrated in FIG. 2.
Figure 3A:
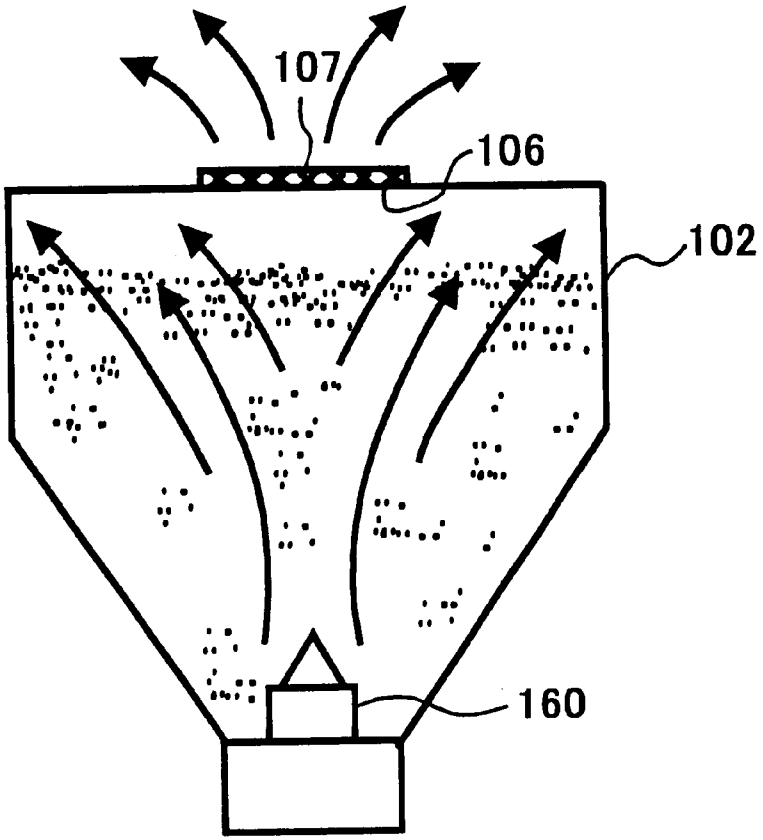

In such a situation, so as to decrease interior pressure, the toner storage container 100 may be provided with an opening 106 as an evacuation section, as illustrated in FIGS. 3A and 3B. In addition, a breathable filter 107 capable of allowing air passage and inhibiting passage of toner may be provided to cover the opening 106. The breathable filter 107 may be disposed on the upper wall of the toner storage container 100 opposite to the seal member 105 which allows insertion of the nozzle 160, so that air which has sufficiently agitated the toner can be evacuated therefrom.

If constructed in the above-described manner, since air supplied to the toner storage container 100 can partially be evacuated outside thereof through the breathable filter 107, the toner storage container 100 can be supplied with air substantially in the limitless manner. Thus, since toner in the toner storage container 100 can be sufficiently agitated by extensively supplied air, the toner can smoothly be suctioned by the powder pump 110, and an amount of remaining toner in the toner storage container 100 can be greatly decreased.

As described above, if a toner storage container 100 is provided with a breathable filter 107, the storage container 100 can be supplied with extensive air. Since extensive air is supplied by the air pump 151 and the full color image forming apparatus includes four toner storage containers 100M, 100C, 100Y, and 100Bk, four units of an air supplying device are necessarily required. However, it is typically costly and needs a large setting space to provide a plurality of air pumps 151.

Figure 4:
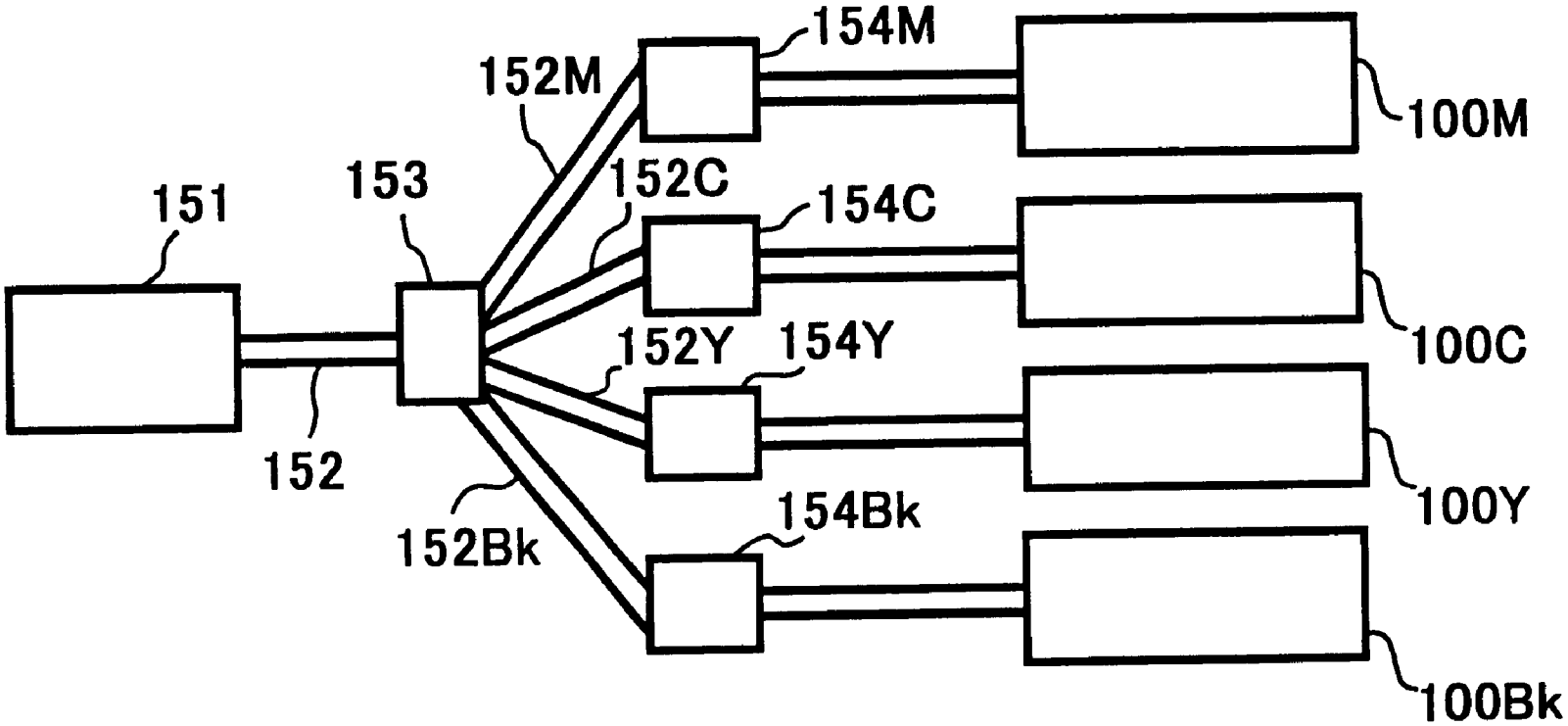
FIG. 4 is a schematic diagram illustrating one embodiment of the toner replenishing device according to the present invention.

To this end, the present invention may be constructed in a manner as illustrated in FIG. 4. As noted from FIG. 4, a plurality of toners having different colors, such as yellow, magenta, cyan, and black may be stored in toner storage containers 100Y, 100M, 100C, and 100Bk, respectively. These toner storage containers 100Y, 100M, 100C, and 100Bk may be provided with air by a prescribed number of air pumps 151 which number is less than that of the toner storage containers 100 (e.g., one in this embodiment). Specifically, a tetra pod section 153 may be provided in an air transfer pipe 152 that is connected to the air pump 151 so as to separate an air supply passage into four parts (i.e., four pipes 152M, 152C, 152Y, 152Bk). These four pipes may be connected to four nozzles 160M, 160C, 160Y, and 160Bk, respectively, which are inserted into the toner storage containers 100M, 100C, 100Y, and 100Bk, respectively. Four openable valves 154M, 154C, 154Y and 154Bk may be provided in the four air transfer pipes 152M, 152C, 152Y, 152Dk, respectively, so as to control air supply. An operation of the air pump 151, and opening and closing operations of the respective four openable valves 154M, 154C, 154Y, and 154Bk, may be controlled by a prescribed control section (not shown).

With a color image forming apparatus constituted in the above-described manner, since one or more air pumps 151 having a fewer number than the toner storage containers 100 are employed, the color image forming apparatus can be compact and its cost can be lowered.

Figure 5:
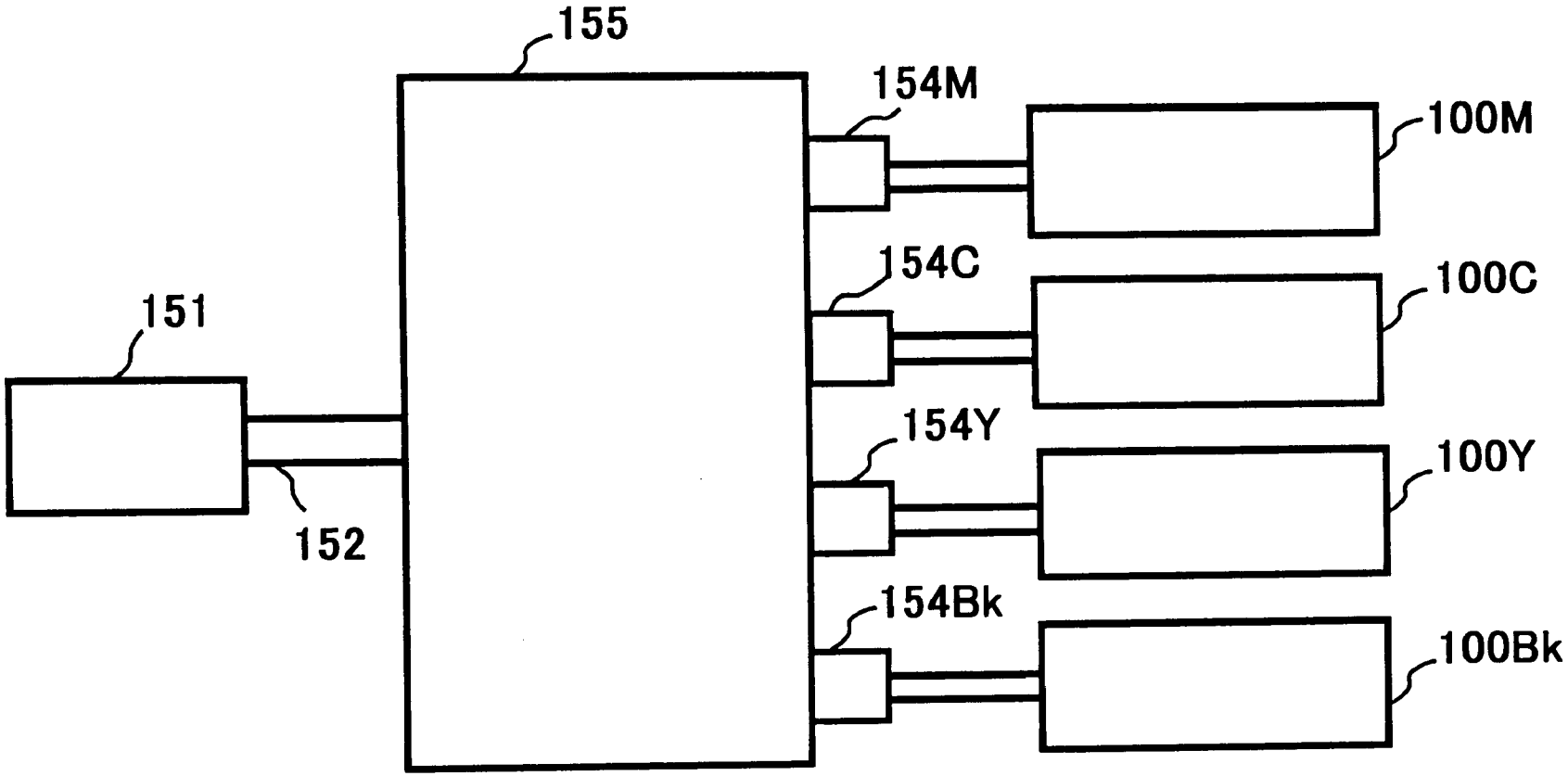
FIG. 5 is a schematic diagram illustrating another embodiment of the toner replenishing device according to the present invention.

The second embodiment will be now described with reference to FIG. 5. A surge tank 155 capable of storing air may be provided between the air pump 151 and each of the toner storage containers 100M, 100C, 100Y, and 100Bk as an air storage section. The four air transfer pipes 152M, 152C, 1523Y, 152Bk, connected to respective ones of the nozzles 160M, 160C, 160Y, and 160Bk which are inserted into the toner storage containers 100M, 100C, 100Y, and 100Bk, respectively, may be included in the surge tank 155. In addition, a plurality of openable valves 154M, 154C, 154Y, and 154Bk may be provided either at a plurality of outlets of the surge tank 155 or a plurality of appropriate sections of the four air transfer pipes 152M, 152C, 1523Y, 152Bk, respectively.

With such a construction, the color image forming apparatus can be compact and a cost thereof can be lowered as in the earlier described embodiment. In the first and second embodiments of FIGS. 4 and 5, when the plurality of openable valves 154M, 154C, 154Y, and 154Bk is open so as to simultaneously supply air to the plurality of toner storage containers 100M, 100C, 100Y, and 100Bk, an amount of the air supplied to each of the plurality of toner storage containers 100M, 100C, 100Y, and 100Bk may be different from others. This is, for example, because when two openable valves 154 are turned ON, air generally is excessively supplied to one of toner storage containers because of its weak pressure due to a lesser amount of toner, and as a result, each of the toner storage containers does not receive exactly half of the supplied air. Specifically, an air supplying amount can not be precisely controlled in such a case.

Figure 6:
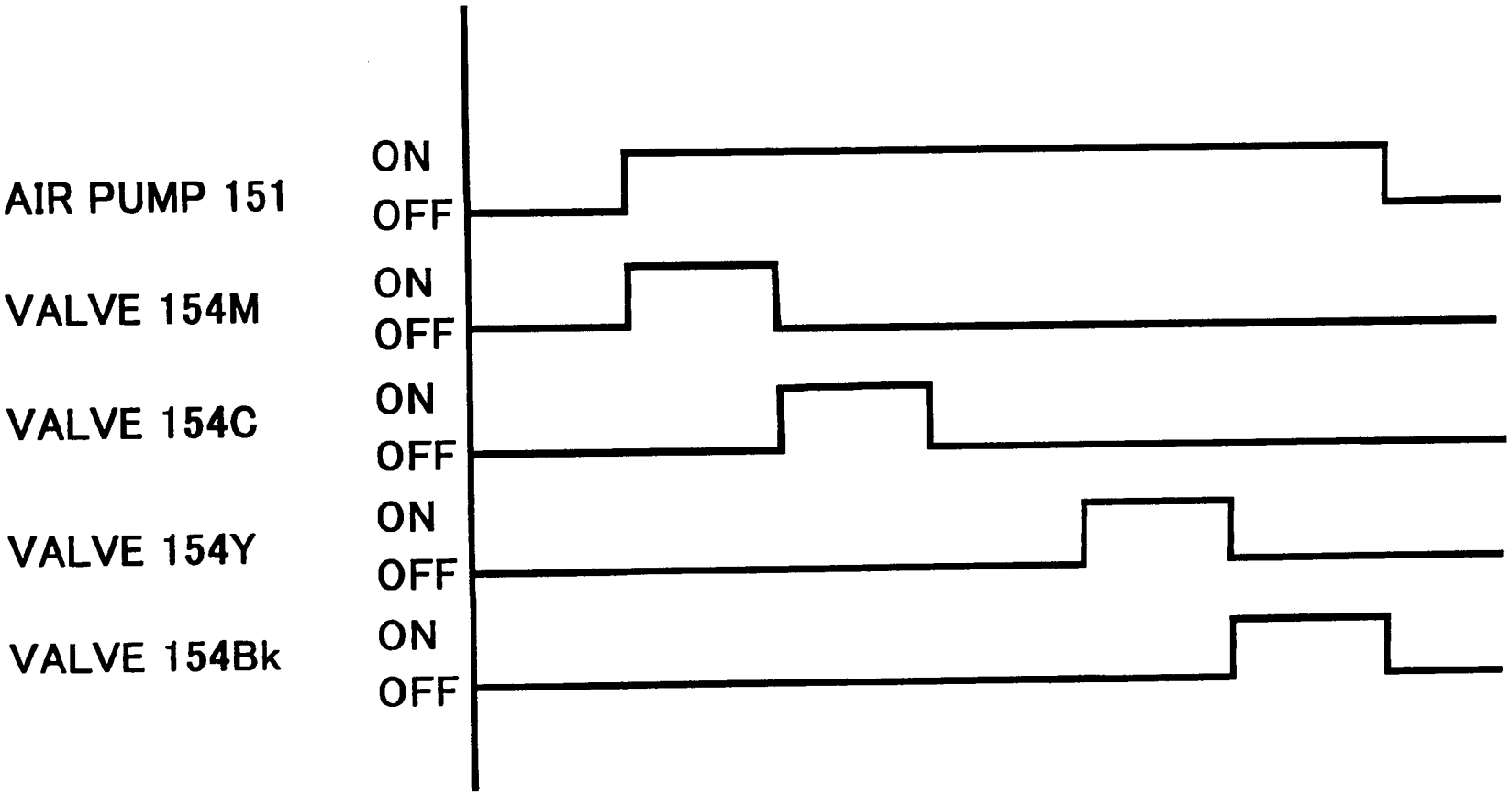
FIG. 6 is a timing chart illustrating exemplary air supply control executed in the embodiment of the toner replenishing device illustrated in FIG. 4.
Figure 7:
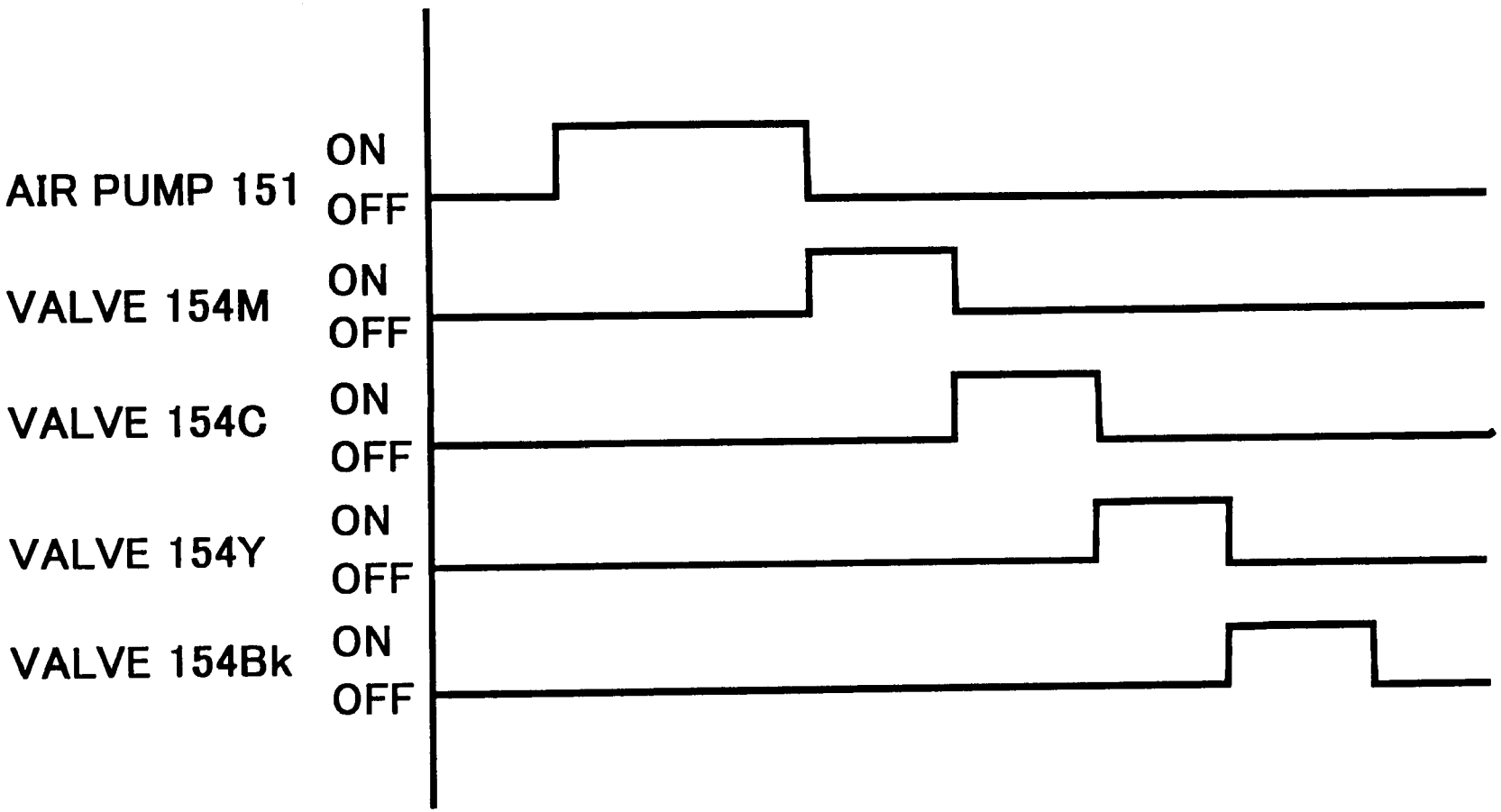
FIG. 7 is a timing chart illustrating exemplary air supply control executed in the embodiment of the toner replenishing device illustrated in FIG. 5.

Then, the plurality of openable valves 154M, 154C, 154Y, and 154Bk illustrated in FIG. 4 may synchronously be turned ON with activation of the air pump 151, but controlled not to simultaneously be turned ON, as illustrated in FIG. 6. Further, as illustrated in FIG.7, the plurality of openable valves 154M, 154C, 154Y, and 154Bk of FIG. 5 may be controlled not to simultaneously be turned ON, even when these openable valves need not be synchronously turned ON with the air pump 151 because of the surge tank 155.

Thus, if the plurality of openable valves is controlled in the above-described manner, an amount of air supplied to each of the toner storage containers 100M, 100, 100Y, and 100Bk can readily be recognized from the capacity of the air pump 151 and its operation time period. As a result, the amount of air can easily be supervised.

Figure 8:
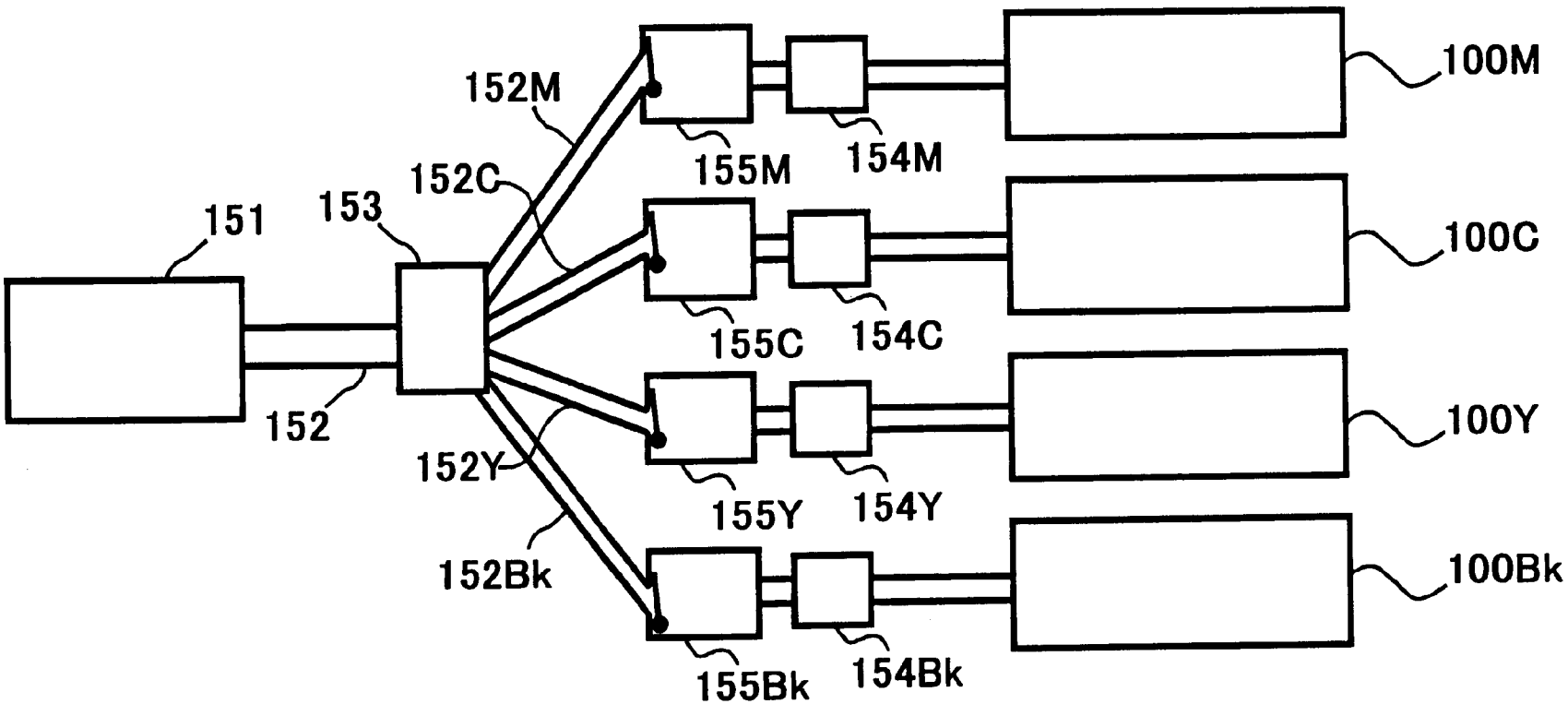
FIG. 8 is a schematic diagram illustrating a modification of the toner replenishing device according to the present invention.

FIG. 8 is a schematic diagram for illustrating another modification of the above-described embodiments. A tetra pod 153 may be provided in an air transfer pipe 152, which is connected to an air pump 151, so as to divide an air supply passage into four parts (i.e., air transfer pipes 152M, 152C, 2152Y, and 152Bk). These four air transfer pipes 152M, 152C, 152Y, and 152Bk may be connected to nozzles 160M, 160C, 160Y, and 160Bk, respectively, which are installed in the toner storage containers 100M, 100C, 100Y, and 100Bk, respectively. The four air transfer pipes 152M, 152C, 152Y, and 152Bk may be provided with valve-cum-surge tanks 155M, 155C, 155Y, and 155Bk, respectively, as an air storage section, and a plurality of openable valves 154M, 154C, 154Y and 154Bk, respectively, as an air supply controller.

Due to such a construction, the image forming apparatus can be compact and its cost can be lowered as in the above-described embodiments. In addition, since the valve-cumsurge tanks 155M, 155C, 155Y and 155Bk are provided to the air transfer pipes 152M, 152C, 152Y, and 152Bk, air can simultaneously be supplied to a plurality of toner storage containers 100. In addition, since the powder pump 110 ejects toner in the toner storage container 100 after air is supplied, it rarely remains therein. As a result, the image forming apparatus can be economical, and a used toner storage container 100 can safely and sanitarily be discarded or recycled.

Figure 9:
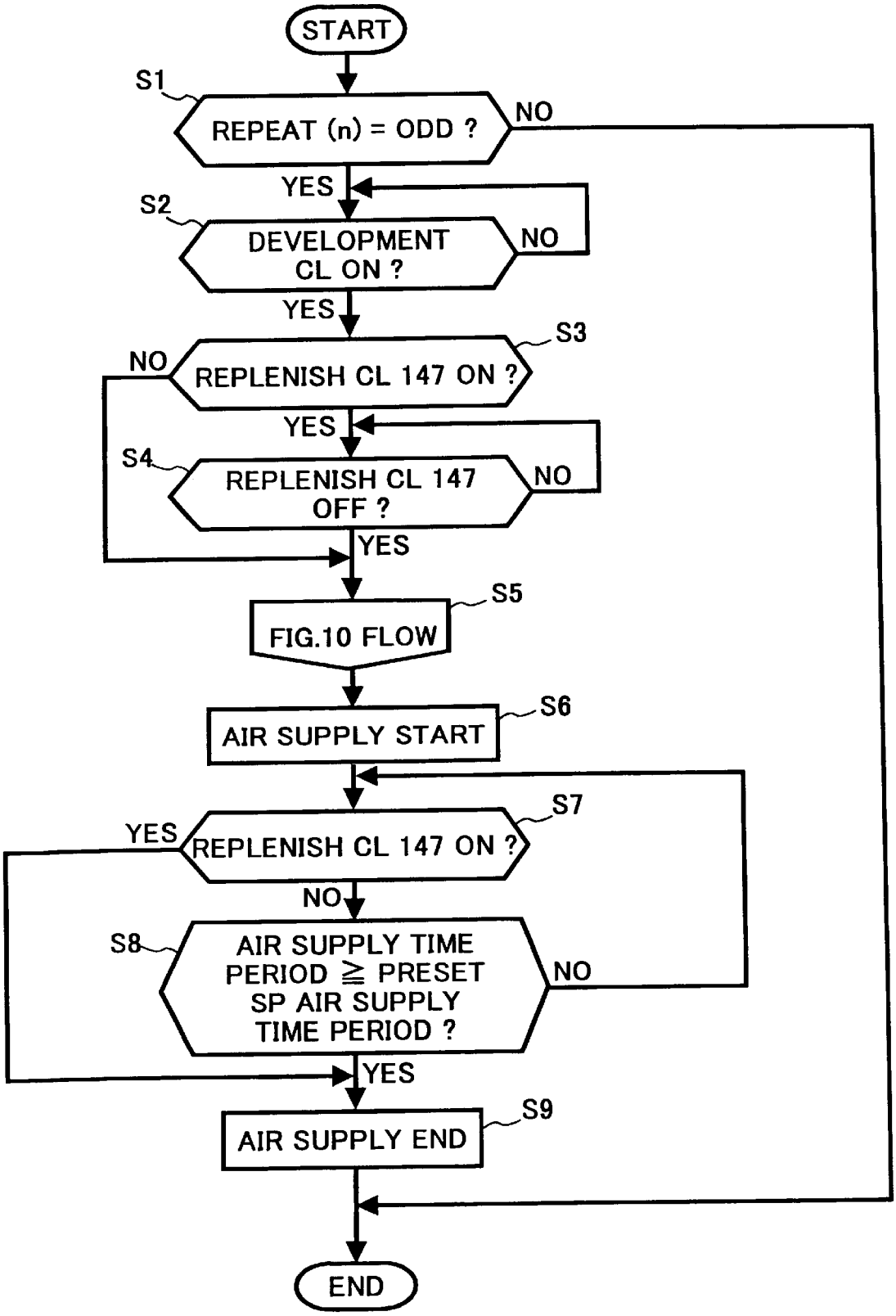
FIG. 9 is a flowchart illustrating air supply control executed in every mono color developing processes of the color laser printer illustrated in FIG. 1.
Figure 10:
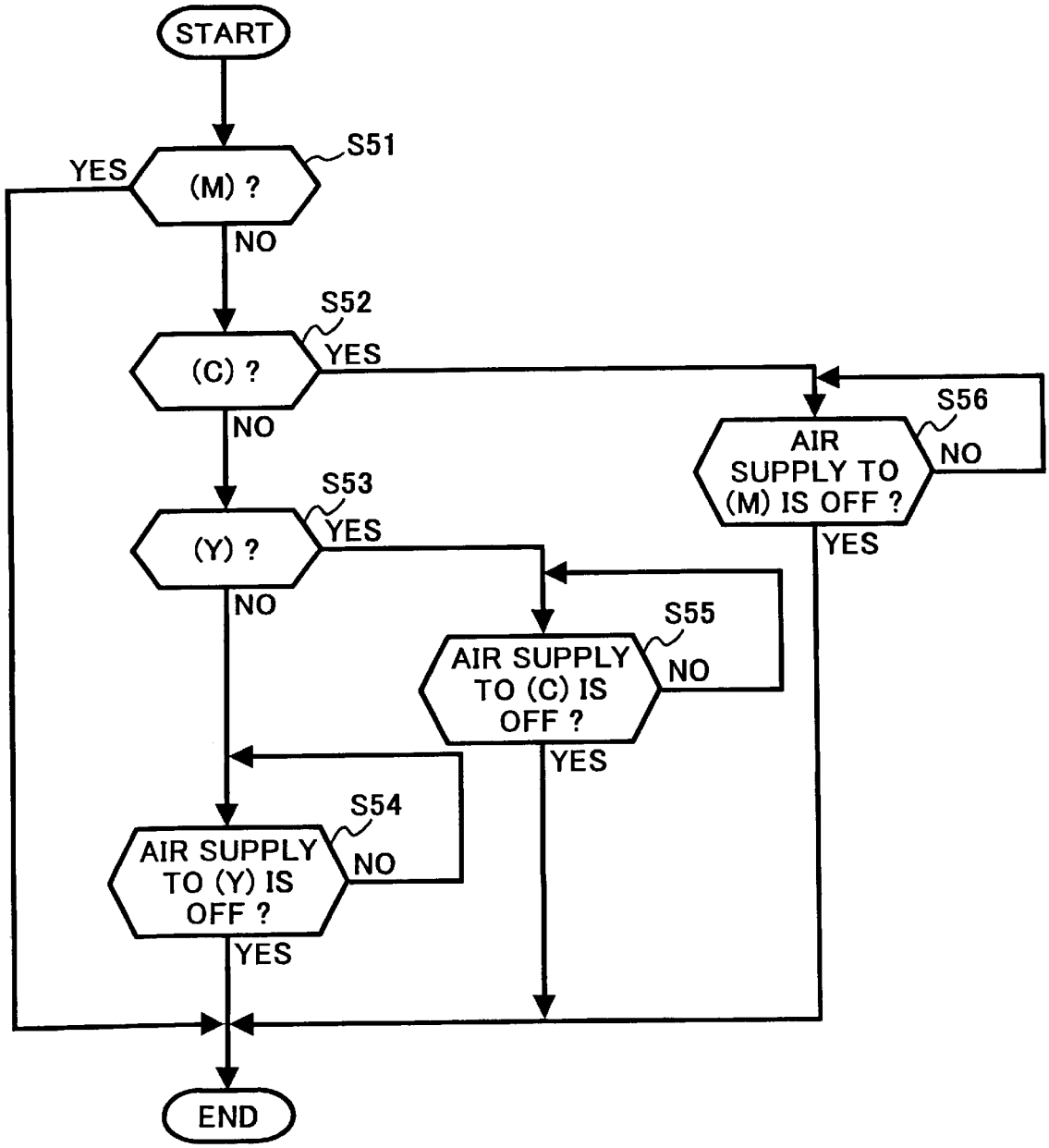
FIG. 10 is a flowchart illustrating in detail one example of an air supply step in the flowchart illustrated in FIG. 9.

Control of air supply to each of the toner storage containers 100M, 100C, 100Y, and 100Bk performed in the color laser printer illustrated in FIG. 1 will now be described with reference to FIGS. 9 and 10.

A toner replenishing process will be now described with reference to FIGS. 9 and 10. When a plurality of mono color developing units in the developing device 10 develops an latent image and is replenished with applicable color toner from applicable toner storage containers 100M, 100C, 100Y, and 100Bk, air supply to applicable toner containers may be controlled in a manner as illustrated in FIGS. 9 and 10. Specifically, the flow may be repeated whenever the mono color developing units start developing the latent image.

Considering air supply efficiency or the like, air may be supplied when image formation is repeated for an odd number. To this end, it may initially be determined if current image formation repetition is related to an odd number (in step S1). Subsequently, when image formation repetition is related to the odd number, it is determined if a development clutch (not shown) is turned ON (in step S2). When the development clutch is turned ON (Yes, in step S2), it is determined if a clutch 147 of the powder pump 110 is turned ON (in step S3). When the clutch 147 is turned ON (Yes, in step S3), a developing device may be supplied with toner. It is then determined whether the clutch 147 is turned OFF (in step S4). When the clutch 147 is deactivated, and as a result toner supply is stopped, the air may be supplied (in step S6). In this instance, since the air is independently supplied to respective ones of toner storage containers 100M, 100C, 100Y and 100Bk as illustrated in FIG. 10, any one of the toner storage containers 100M, 100C, 100Y, and 100Bk may be selected, one by one, to be supplied with the air (in steps S51 through S56).

Specifically, when a latent image is developed by the magenta developing unit (Yes in step S51), which initially develops the latent image, air supply for the magenta toner container may start (in step S6). If the image is subsequently developed by the cyan developing unit (No, in step S51, Yes, in step S52), and the air supply to the magenta toner container is turned OFF (Yes, in step S56) as illustrated in FIGS. 6 and 7, air supply for the cyan toner container may start (in step S6). If the image is subsequently developed by the yellow developing unit (No, in step S52, Yes, in step S53), and the air supply to the cyan toner container is turned OFF (Yes, in step S55) as illustrated in FIGS. 6 and 7, air supply for the yellow toner container may start (in step S6). If the image is developed by the black developing unit (No, in step S53), and the air supply to the yellow toner container is turned OFF (Yes, in step S54) as illustrated in FIGS. 6 and 7, air supply for the black toner container may start (in step S6).

Whenever the air supply has not yet been completed in the previous color developing process, the present air supply may wait for termination thereof (No, in steps S54, S55, and S56). The air supply may be stopped when the clutch 147 is turned ON (Yes, in step S7), or a prescribed preset air supply tome period has elapsed after air supply start (Yes, in step S8).

The third embodiment will now be described with reference to FIGS. 11 and 12. In the image forming apparatus, toner remaining on a transfer member such as an image carrier, a transfer belt, etc., is typically collected by a cleaning device, and the collected toner is generally reusable. To reuse the collected toner, since the cleaning device is generally disposed far from a developing device due to different functions, it should generally be conveyed.

Figure 12:
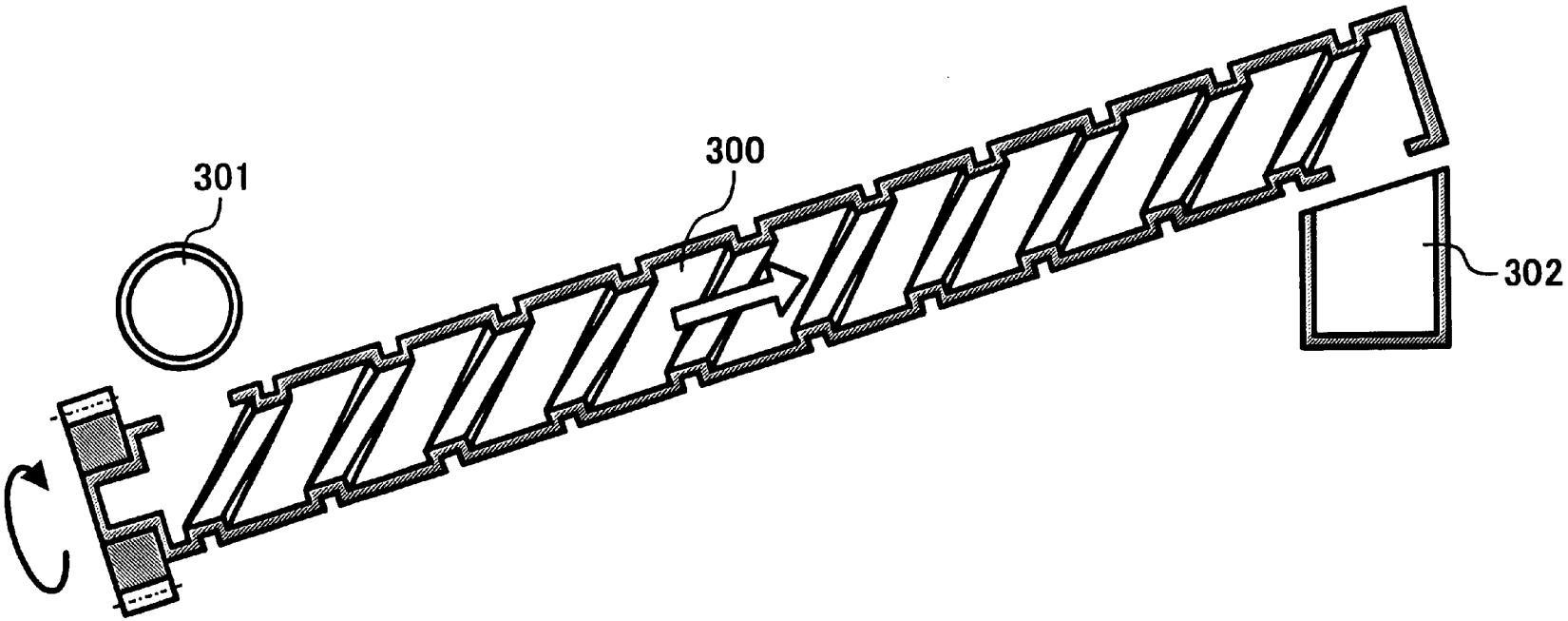
FIG. 12 is a schematic diagram illustrating one example of a conventional toner conveying device.

FIG. 12 illustrates on example of a conventional collected toner conveyance device. As noted therefrom, toner collected by a cleaning device is ejected from an ejection outlet 301 and received by a spiral shaped pipe 300 at its one end. The collected toner is conveyed when the spiral shaped pipe 300 is rotated in a prescribed direction to an inlet 302 of a developing device, which inlet is provided beside the other end of the spiral shaped pipe 300. However, such a collected toner conveyance generally imposes abnormal stress on the collected toner, resulting in toner blocking (i.e., coagulation due to melting adhesion, etc.), crushing, etc. Thus, toner characteristics vary and toner conveyance may sometimes be impossible. In addition, the spiral shaped pipe 300 and its drive member may occasionally be damaged. In addition, since toner characteristics vary due to the stress, there is a problem wherein a color image forming apparatus typically produces a low quality color image having a plurality of spots.

Figure 11:
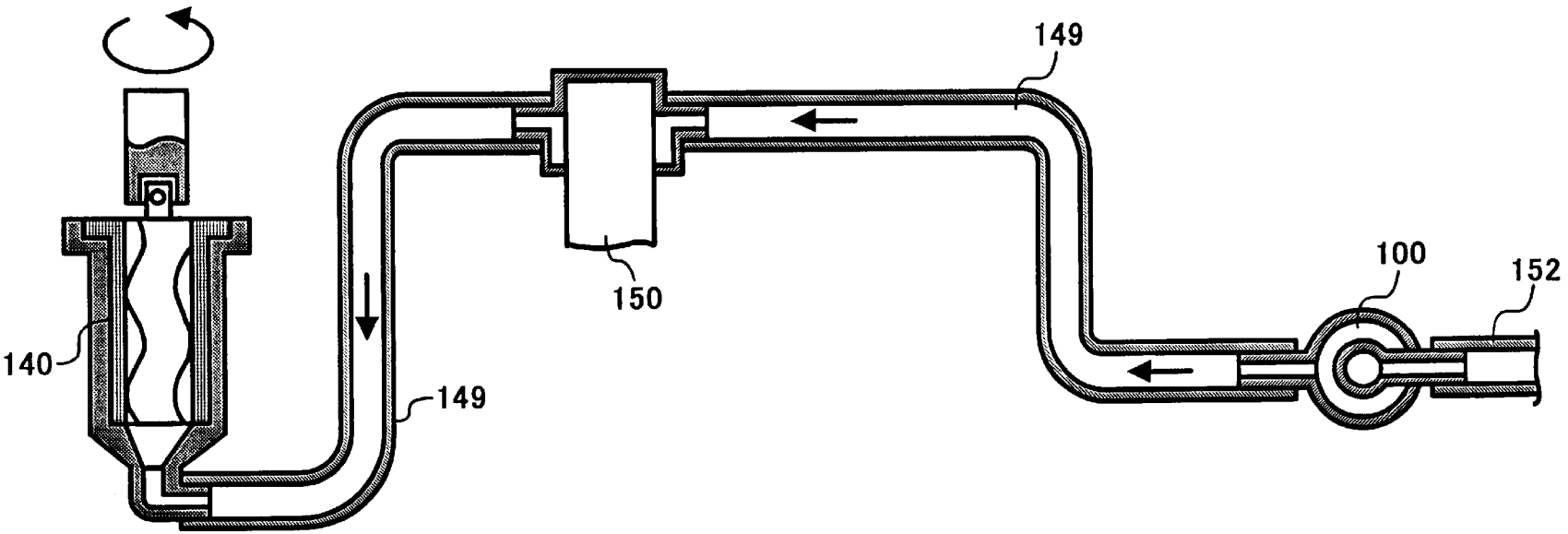
FIG. 11 is a schematic diagram illustrating another embodiment of the toner replenishing device according to the present invention.

According to the third embodiment of the present invention of FIG. 11, a toner conveyance tube 149, which connects a toner storage container 100 with a powder pump 140 provided in the vicinity of the developing device 10, may be arranged via a collected toner ejection outlet 150 which is disposed in the vicinity of the cleaning device (not shown). Since the toner conveyance tube 149 is flexible, the conveyance tube 149 can readily be arranged via the collected toner ejection outlet 150.

Thus, since fresh toner stored in the toner storage container 100 is conveyed to the developing device 10 via the collected toner ejection outlet 150, the fresh toner can be mixed with the collected toner from the middle of a toner conveyance process. In addition, since toner conveyance by the powder pump 140 substantially does not impose needless stress, and new toner is conveyed while being mixed with air along the toner conveyance members, mechanical stresses substantially are not imposed on collected toner mixed with the fresh toner.

Thus, if collected toner is reused, since a toner conveyance process substantially does not impose needless stress on the collected toner, an image formed by using such collected toner can substantially surely prevent generation of spots or the like in an image.

The mechanisms and processes set forth in the present invention may be implemented using one or more conventional general purpose microprocessors and/or signal processors programmed according to the teachings in the present specification as will be appreciated by those skilled in the relevant arts. Appropriate software coding can readily be prepared by skilled programmers based on the teachings of the present disclosure, as will also be apparent to those skilled in the relevant arts. However, as will be readily apparent to those skilled in the art, the present invention also may be implemented by the preparation of application-specific integrated circuits by interconnecting an appropriate network of conventional component circuits or by a combination thereof with one or more conventional general purpose microprocessors and/or signal processors programmed accordingly. The present invention thus also includes a computer-based product which may tee hosted on a storage medium and include, but is not limited to, any type of disk including floppy disks, optical disks, CD-ROMs, magnet-optical disks, ROMs, RAMs, EPROMS, EEPROMs, flash memory, magnetic or optical cards, or any type of media suitable for storing electronic instructions.

Numerous additional modifications and variations of the present invention are possible in light of the above teachings. It is therefore to be understood that within the scope of the appended claims, the present invention may be practiced otherwise than as specifically described herein.

What is claimed as new and desired to be secured by Letter Patent of the United States is:

1. A toner container, comprising:

a container body having a mouth configured to allow toner contained in the container body to be discharged to a developing device, and having an opening located at a position opposite to the mouth;

a filter corresponding to a position of the opening of the container body and configured to allow air within the container body to escape; and a mouthpiece member mounted on the mouth of the container body and including an open/closeable valve configured to allow a stationary nozzle in a set portion of an image forming apparatus to protrude through the valve into the container body when the toner container is mounted to the set portion, and configured to close and seal the mouth when the toner container is not mounted to the set portion.

2. The toner container according to claim 1, wherein the open/closeable valve comprises a resilient member.

3. The toner container according to claim 2, wherein the resilient member comprises an expanded sponge material.

4. The toner container according to claim 1, wherein the container body has a shape narrowing toward the mouth.

5. The toner container according to claim 1, wherein toner contained within the container body is sucked through the stationary nozzle to the developing device when the developing device is being supplied with toner from the container body, and air is pumped into the container body through the stationary nozzle to agitate the toner in the container body during a period of time when the developing device is not being supplied with toner, and wherein excess air pumped into the container body escapes through the filter to an outside of the container body such that a maximum amount of air may be pumped into the container body.

6. The toner container according to claim 1, wherein the filter is a breathable filter configured to allow air to pass therethrough so as to escape to an outside of the container body, and configured to inhibit toner contained within the container body from escaping through the breathable filter.

7. The toner container according to claim 1, wherein when the toner container is mounted to the set portion of the image forming apparatus, the filter is located above the mouth of the container body.

8. A toner container, comprising:

container body means for storing toner and including first means for allowing toner contained in the container body means to be discharged to a developing device, and second means for allowing air within the container body means to escape, said second means being located at a position opposite to the first means; and valve means associated with the first means of the container body means for allowing a stationary nozzle in a set portion of an image forming apparatus to protrude through the valve means into the container body means when the toner container is mounted to the set portion such that toner contained in the container body means may be discharged to the developing device, and for sealing the first means to prevent toner from being discharged from the container body means when the toner container is not mounted to the set portion.

9. The toner container according to claim 8, wherein the container body means has a shape narrowing toward the first means.

10. The toner container according to claim 8, wherein toner contained within the container body means is sucked through the stationary nozzle to the developing device when the developing device is being supplied with toner from the container body means, and air is pumped into the container body means through the stationary nozzle to agitate the toner in the container body means during a period of time when the developing device is not being supplied with toner, and wherein excess air pumped into the container body means escapes through the second means to an outside of the container body means such that a maximum amount of air may be pumped into the container body means.

11. The toner container according to claim 8, wherein the second means comprises a breathable filter for allowing air to pass therethrough so as to escape to an outside of the container body means, and for inhibiting toner contained within the container body means from escaping through the breathable filter.

12. The toner container according to claim 8, further comprising:

means for mounting the valve means to the container body means.

13. The toner container according to claim 8, wherein the valve means comprises a resilient member.

14. The toner container according to claim 13, wherein the resilient member comprises an expanded sponge material.

15. The toner container according to claim 8, wherein when the toner container is mounted to the set portion of the image forming apparatus, the second means is located above the first means of the toner container.

16. A method for replenishing toner, comprising:

sucking toner from a container body through a mouth of the container body so as to discharge the toner to a developing device;

pumping air into the container body through the mouth during a period of time toner is not being sucked from the container body; and allowing excess air pumped into the container body to escape through an opening located at a position opposite to the mouth to an outside of the container body such that a maximum amount of air may be pumped into the container body.

17. The method according to claim 16, wherein the sucking step sucks toner from the container body through an open/closeable valve associated with the mouth and that is opened when a stationary nozzle in a set portion of an image forming apparatus protrudes through the valve into the container body and when the toner container is installed to the set portion, wherein the pumping step pumps air into the container body through the opened valve during a period of time when toner is not being sucked from the container body, and wherein the valve closes and seals the mouth of the container body to prevent toner from discharging from the container body when the toner container is not mounted to the set portion.

18. The method according to claim 17, wherein the open/closeable valve comprises a resilient member.

19. The method according to claim 18, wherein the resilient member comprises an expanded sponge material.

20. The method according to claim 16, wherein the container body has a shape narrowing toward the mouth.

21. The method according to claim 16, wherein when the toner container is mounted to the set portion of the image forming apparatus, the opening is located above the mouth of the toner container.

22. A toner replenishing device comprising:

a toner conveyance path extending from a toner container to a developing device;

a toner conveying device configured to convey the toner from the toner container to the developing device along the toner conveyance path; and an air supplying device configured to supply the toner container with air, wherein the toner container includes, a container body having a mouth configured to allow toner contained in the container body to be discharged to a developing device, and having an opening located at a position opposite to the mouth;

a filter corresponding to a position of the opening of the container body and configured to allow air within the container body to escape; and a mouthpiece member mounted on the mouth of the container body and including an open/closeable valve configured to allow a stationary nozzle in a set portion of an image forming apparatus to protrude through the valve into the container body when the toner container is mounted to the set portion, and configured to close and seal the mouth when the toner container is not mounted to the set portion.

23. The device according to claim 22, wherein the open/closeable valve comprises a resilient member.

24. The device according to claim 23, wherein the resilient member comprises an expanded sponge material.

25. The device according to claim 22, wherein the container body has a shape narrowing toward the mouth.

26. The device according to claim 22, wherein toner contained within the container body is sucked through the stationary nozzle to the developing device when the developing device is being supplied with toner from the container body, and air is pumped into the container body through the stationary nozzle to agitate the toner in the container body during a period of time when the developing device is not being supplied with toner, and wherein excess air pumped into the container body escapes through the filter to an outside of the container body such that a maximum amount of air may be pumped into the container body.

27. The device according to claim 22, wherein the filter is a breathable filter configured to allow air to pass therethrough so as to escape to an outside of the container body, and configured to inhibit toner contained within the container body from escaping through the breathable filter.

28. The device according to claim 22, wherein when the toner container is mounted to the set portion of the image forming apparatus, the filter is located above the mouth of the toner container.

* * * * *